US006209332B1

(12) United States Patent
Strauss

(10) Patent No.: US 6,209,332 B1
(45) Date of Patent: Apr. 3, 2001

(54) CIRCUIT CONFIGURATION FOR OPERATING AN ELECTRICALLY TRIGGERABLE MAGNET VALVE AND REFRIGERATION APPLIANCE HAVING THE CIRCUIT CONFIGURATION

(75) Inventor: Georg Strauss, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 08/805,329

(22) Filed: Feb. 24, 1997

Related U.S. Application Data

(63) Continuation of application No. PCT/EP95/02621, filed on Jul. 6, 1995.

(30) Foreign Application Priority Data

Aug. 23, 1994 (DE) ..... 44 29 919

(51) Int. Cl.[7] ..... F25B 41/04
(52) U.S. Cl. ..... 62/199; 62/158
(58) Field of Search ..... 62/198, 199, 200, 62/158, 157, 231, 207

(56) References Cited

U.S. PATENT DOCUMENTS 3,001,378 * 9/1961 Stutrud ..... 62/199 X
4,439,998 * 4/1984 Horvay et al. ..... 62/200 X

* cited by examiner

*Primary Examiner*—Harry B. Tanner
(74) *Attorney, Agent, or Firm*—Herbert L. Lerner; Laurence A. Greenberg

(57) ABSTRACT

A circuit configuration operates an electrically triggerable magnet valve having a valve-control element adjustable into at least two working positions for selecting one fluid-flow path at a time to be acted upon by a fluid and corresponding to a respective working position. The circuit configuration includes a device for adjusting the valve-control element into a different working position in connection with an imposition of fluid, predominantly present in liquid components, on at least a portion of a fluid-flow path formed by the magnet valve. A refrigeration appliance, in particular a refrigerator or freezer or a combination refrigerator-freezer includes the circuit configuration.

8 Claims, 2 Drawing Sheets

CIRCUIT CONFIGURATION FOR OPERATING AN ELECTRICALLY TRIGGERABLE MAGNET VALVE AND REFRIGERATION APPLIANCE HAVING THE CIRCUIT CONFIGURATION

CROSS-REFERENCE TO RELATED APPLICATION

This application is a Continuation of International Application Serial No. PCT/EP95/02621, filed Jul. 6, 1995.

BACKGROUND OF THE INVENTION

Field of the Invention

The invention relates to a circuit configuration for operating an electrically triggerable magnet valve having a valve-control element that can be put into at least two working positions and through the adjustment of which one fluid-flow path at a time that is acted upon by a fluid and that corresponds to the respective working position can be selected.

Circuit configurations as defined above are used, for instance, in refrigeration appliances that have a plurality of compartments at different temperatures, for triggering bistable magnet valves that are used there. On the basis of such valves a flow of refrigerant generated by a compressor in a refrigeration circuit is conducted to evaporators in the compartments having various temperatures in accordance with the need for refrigeration. To that end, the valve-control element of the bistable magnet valve is moved into one or the other of its working positions in accordance with the need for refrigeration in storage compartments of the refrigeration appliance. That is done through the use of the force exerted on the valve-control element by the electromagnets and as a consequence of that force the valve-control element is accelerated into its closing position. A clearly audible noise is generated by the closing process. In the past, that noise had been handled through the use of sound damping provisions made in the valve-control element, in the form of plastic parts that cause the closure of nozzle-like supply openings. In the case of such plastic parts, however, if they are not to wear prematurely at the nozzle-like supply openings, a relatively high Shore hardness must be chosen, which necessarily in turn causes not inconsiderable worsening of the acoustical insulation.

SUMMARY OF THE INVENTION

It is accordingly an object of the invention to provide a circuit configuration for operating an electrically triggerable magnet valve and a refrigeration appliance having the circuit configuration, which overcome the hereinafore-mentioned disadvantages of the heretofore-known devices of this general type and which enable low-noise operation of an electrically triggerable magnet valve in a simple way.

With the foregoing and other objects in view there is provided, in accordance with the invention, a circuit configuration for operating an electrically triggerable magnet valve having a valve-control element adjustable into at least two working positions for selecting one fluid-flow path at a time to be acted upon by a fluid and corresponding to a respective working position, the circuit configuration comprising a device for adjusting the valve-control element into a different working position in connection with an imposition of fluid, predominantly present in liquid components, on at least a portion of a fluid-flow path formed by the magnet valve.

Due to the structure according to the invention, speed damping and attendant noise damping for the moving valve-control element are generated, with the damping being constant over the service life of the electrically triggerable magnet valve and being generated by the liquid fluid, since the noise damping is independent of possible changing material properties of materials typically used for acoustical insulation, for example the process of aging in plastics. Moreover, the extent of damping for the valve-control element can be varied in a simple way through the use of the geometrical structure of the valve-control element.

In accordance with another feature of the invention, the device for imposing the liquid fluid on the portion of the fluid-flow path formed by the magnet valve is attained by a time lag in the adjustment of the valve-control element with respect to an activation of a device for driving the fluid.

The use of such a structure assures that liquid fluid is imposed on the portion of the fluid-flow path formed by the magnet valve in an especially simple way, without additional expense for sensors.

In accordance with a further feature of the invention, the time lag can be generated especially simply if the device effecting the time lag is formed by an essentially electromechanically constructed timing element. Moreover, such a timing element is distinguished by its sturdy construction.

In accordance with an added feature of the invention, the device effecting the time lag is formed by a timing element composed of electronic components.

In such a structure, the order of magnitude of the time lag can also be varied retroactively in a simple way. Moreover, such a timing element can be made extremely economically.

In accordance with an additional feature of the invention, the time lag is in a range between 30 seconds and 90 seconds.

In accordance with yet another feature of the invention, a time lag that proves to be especially pertinent is 60 seconds.

In accordance with a concomitant feature of the invention, the device serving to drive the fluid is constructed as a refrigerant compressor.

With the objects of the invention in view there is also provided a refrigeration appliance, in particular a refrigerator or freezer or a combination refrigerator-freezer which includes the circuit configuration.

Other features which are considered as characteristic for the invention are set forth in the appended claims.

Although the invention is illustrated and described herein as embodied in a circuit configuration for operating an electrically triggerable magnet valve and a refrigeration appliance having the circuit configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
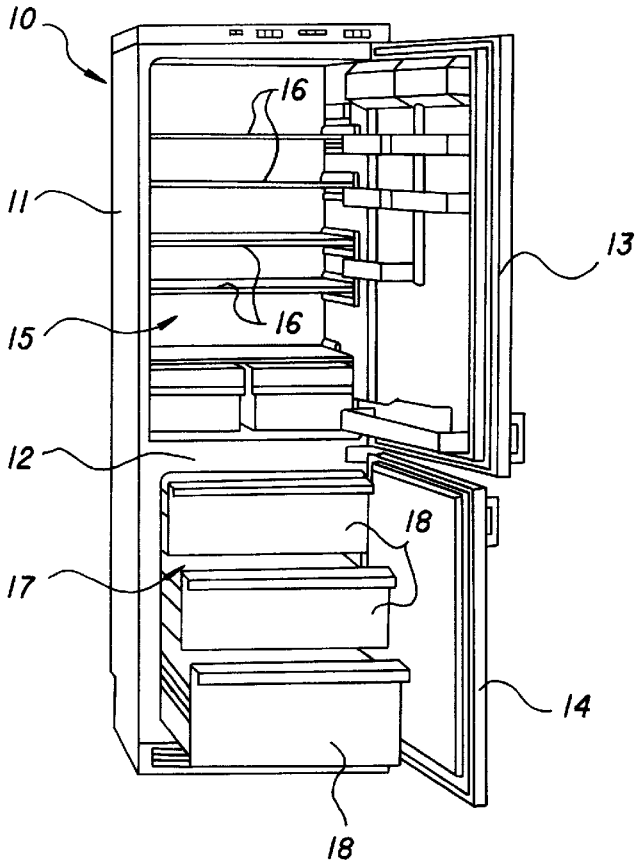
FIG. 1 is a diagrammatic, perspective view of a two-temperature refrigerator shown with opened doors, including a refrigerator compartment and a freezer compartment having temperatures that are controlled by an electronic regulating device.

Referring now to the figures of the drawings in detail and first, particularly, to FIG. 1 thereof, there is seen a combination refrigerator and freezer 10 which has a heat-insulating housing 11 with two storage compartments that are disposed vertically one above the other, are thermally separated from one another by a heat-insulating partition 12 and are closable with separate doors 13 and 14. The higher storage compartment, which is closable with the door 13, is constructed as a refrigerator compartment 15 and is equipped with shelves 16 that are disposed one above the other at vertical intervals and are intended for storing things to be refrigerated. The other storage compartment 17, which is located below the refrigerator compartment 15, is separated from it by the heat-insulating partition 12 and is closable by the door 14, is constructed as a freezer compartment, which is equipped with frozen-product containers 18 that can be pulled out like drawers to hold things to be frozen.

Figure 2:
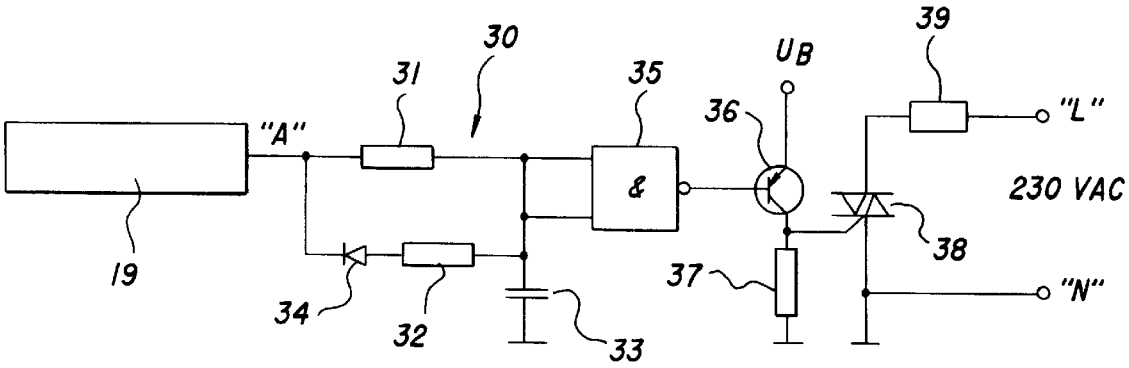
FIG. 2 is a schematic and block circuit diagram of the electronic regulating device with an electronic circuit configuration for generating trigger signals for triggering an electromagnet valve that controls a flow of refrigerant to the freezer compartment or the refrigerator compartment.
Figure 3:
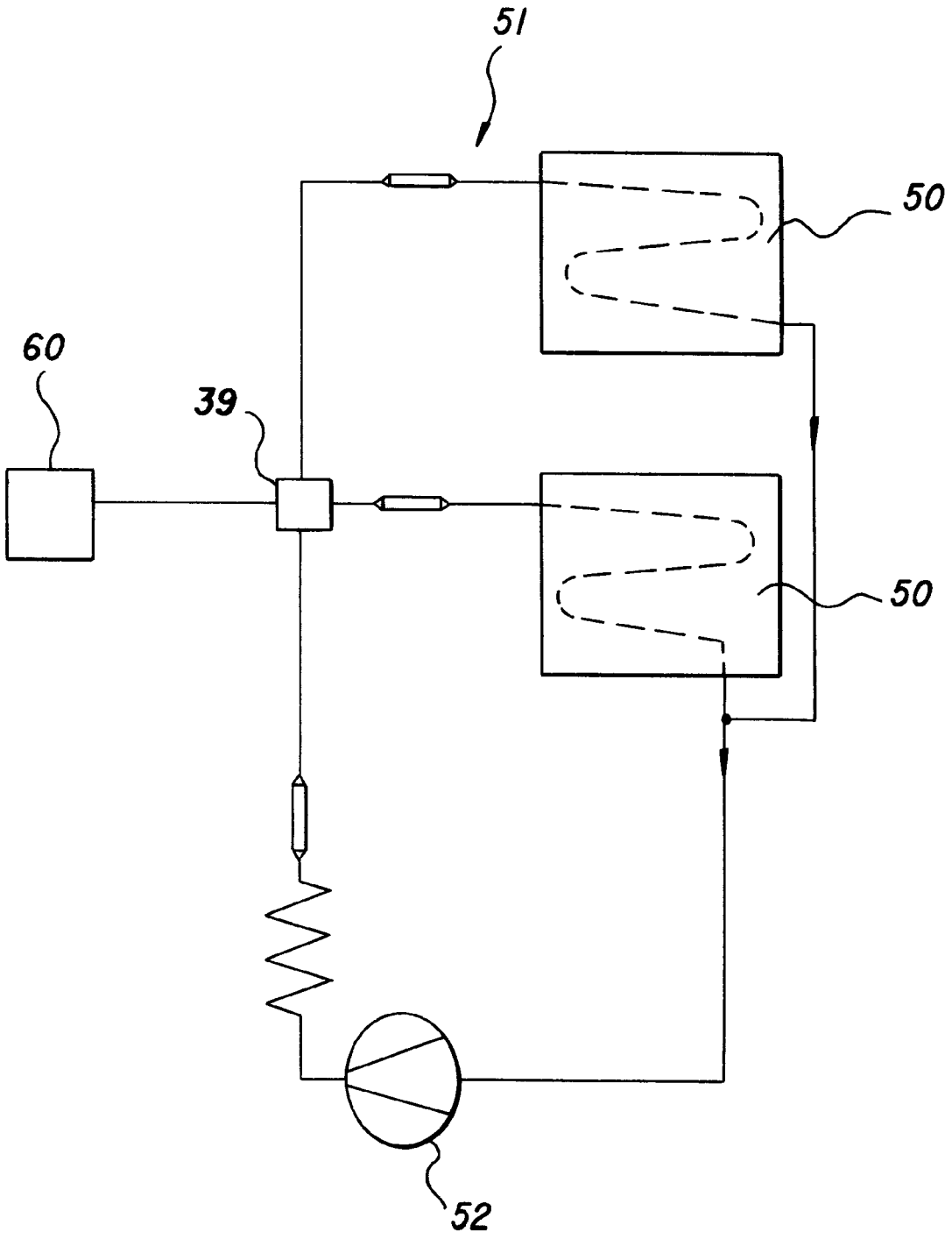
FIG. 3 is a schematic diagram of a refrigeration circuit.

FIG. 3 shows that both the refrigerator compartment 15 and the freezer compartment 17 are equipped with evaporators 50 for maintaining their intended storage chamber temperature. The evaporators are incorporated into a likewise refrigeration circuit 51 within which a compressor 52 that supplies the evaporators 50 with liquid refrigerant is disposed. The compressor 52 is operated intermittently, and phases in which the compressor 52 is turned on and off are dependent on the temperatures prevailing in the storage compartments. On one hand, these temperatures are detected by non-illustrated temperature sensors and processed to form values that can be indicated by temperature indicator elements in an evaluation logic element 19 that is part of an electronic regulating device. On the other hand they are processed into a digital signal "A" seen in FIG. 2 that can be further processed in a circuit configuration 30.

As is seen particularly in FIG. 2, the digital signal "A" that is present at the output side of the evaluation logic element 19 represents an input signal for the circuit configuration 30, which is equipped on the input side with two RC elements serving to attain different time periods. These elements are formed by two parallel-connected ohmic resistors 31 and 32 with different resistances and one common capacitor 33 in series circuit therewith. A diode 34 precedes the resistor 32 with the lower resistance and has an anode terminal connected to the resistor 32, so that the charging process of the capacitor 33 takes place through the higher-impedance resistor 31. The voltage potential generated by the charging process at the capacitor 33 is applied to combined inputs of a NAND gate 35 having an output signal which is delivered to a base of a pnp transistor 36. The pnp transistor 36 has an emitter terminal which is connected to a direct voltage supply "$U_B$" and a collector terminal which is connected to ground potential through an ohmic resistor 37 that limits the collector current. A gate terminal for tapping an ignition current for a triac 38 is disposed between the collector terminal of the pnp transistor 36 and the ohmic resistor 37. The triac 38 has a main electrode terminal which is coupled through a monostable electromagnet valve 39 that controls two fluid-flow paths to a line pole "L" of a 230-volt alternating voltage. Another main electrode terminal of the triac 38 is connected to a zero pole "N" of the alternating voltage supply, which at the same time also forms a ground terminal for this main electrode of the triac 38.

A requirement for refrigeration of the refrigerator compartment 15 in response to a rising storage temperature therein is signaled at the output of the evaluation logic element 19 by a logical "1" for the output signal "A", which on one hand signifies the activation of the refrigerant compressor and on the other hand signifies a switchover process of the monostable magnet valve 39 from its position of repose for changing the fluid-flow path for the refrigerant to the evaporator of the refrigerator compartment 15. The switchover process of the electrically triggerable magnet valve 39 is delayed in time, as compared with the turn-on process of the compressor, by the RC element formed of the resistor 31 and the capacitor 33. This is because the logical "1" at the output of the evaluation logic element 19 is applied to the combined inputs of the NAND gate 35 only after the conclusion of the charging process of the capacitor 33 and generates a logical "0" at the output of this NAND gate that is delivered to the base of the pnp transistor 36 acting as an electronic switch, thereby putting this transistor into the conducting state. The current flowing between the emitter and the collector of the pnp transistor 36 as a result of its conduction state acts as an ignition current for the triac 38, thereby closing the circuit for the monostable magnet valve 39, so that the desired change of position of its valve-control element, acting for the electromagnets, occurs in order to divert the refrigerant to the evaporator of the refrigerator compartment 15.

The triggering of the magnet valve 39 is delayed, as already described, as compared with the triggering of the compressor, due to the input-side connection of the NAND gate 35 with the RC element formed of the resistor 31 and the capacitor 33. Intrinsically, because of the output signal "A" being output by the evaluation logic element 19 in the event of a need for refrigerant for the refrigerator compartment 15, this triggering should occur simultaneously. Due to the time lag between when the compressor is put into operation and when the fluid-flow path for the refrigerant is changed by the magnet valve 39, it is assured that the latter experiences a flow through it of refrigerant in the liquid phase, so that the switchover motion of the valve-control element that effects the change of direction for the flow takes place in a way that is damped by liquid and thus is maximally noiseless, without additional damping provisions having to be taken. Times that are usable for the order of magnitude of the time lags are those between 30 seconds and 90 seconds which have already shown good results, and a delay of 60 seconds has proved favorable.

FIG. 3 also shows that an electromechnically constructed timing element 60 can be used for generating the time lag.

Instead of the activation of the magnet valve 39 taking place after the compressor, it is equally possible to provide a liquid sensor to monitor the liquid level in the magnet valve 39 in order to assure the liquid damping for the valve-control element.

Once the storage temperature in the refrigerator compartment 15 has reached its intended desired value, this is signaled through temperature sensors to the evaluation logic element 19, whereupon this logic element outputs a signal for putting the compressor out of operation and outputs a logical "0" as its output signal "A". This output signal is applied to the input of the NAND gate 35 as a switchover signal for the magnet valve 39, delayed by the discharge time of the capacitor 33. Since the resistance of the resistor 32 is much lower than that of the resistor 31, the switchover process of the magnet valve 39 into its position of repose that opens the fluid-flow path to the freezer compartment evaporator takes place virtually simultaneously with the stopping of the compressor. Due to the slight time lag, for which a time of 50 ms has already proved favorable, it is assured that at least the fluid-flow path of the refrigeration circuit specified by the magnet valve 39 still has liquid refrigerant imposed on it, and thus the switchover process of the valve-control element takes place in a liquid-damped fashion and thus virtually noiselessly.

In the event that a need for refrigeration is reported for the freezer compartment 17, the evaluation signal "A" of the evaluation logic element 19 is a logical "0", and as a result a logical "1" is applied to the NAND gate 35. The transistor 38 thus blocks, causing the triac 38 to be inactive and thus depriving the magnet valve 39 of current.

Instead of the circuit configuration 30 which is made up of discrete electronic components in the exemplary embodiment, it is also conceivable for its function and that of the evaluation logic element 19 to be simulated by a suitably programmed microprocessor, so that the delayed putting of the magnet valve 39 into operation as compared with the compressor can be accomplished by a suitable software program.

It is understood that the invention is also applicable to a wiring of a bistable magnet valve with a valve-specific wiring change that would then be provided in this wiring.

I claim:

1. A circuit configuration for operating an electrically triggerable magnet valve having a valve-control element adjustable into at least two working positions for selecting one fluid-flow path at a time to be acted upon by a fluid and corresponding to a respective working position, the circuit configuration comprising:

means for adjusting a valve-control element of a magnet valve into a different working position in connection with an imposition of fluid, predominantly present in liquid components, on at least a portion of a fluid-flow path formed by the magnet valve.

2. The circuit configuration according to claim 1, including a device for driving the fluid, said means for adjusting a valve-control element for imposing the liquid fluid on the portion of the fluid-flow path formed by the magnet valve being effected by a time lag in the adjustment of the valve-control element with respect to an activation of the fluid driving device.

3. The circuit configuration according to claim 2, wherein the device effecting the time lag is an essentially electromechanical timing element.

4. The circuit configuration according to claim 2, wherein the device effecting the time lag is a timing element having electronic components.

5. The circuit configuration according to claim 2, wherein the time lag is in a range between 30 seconds and 90 seconds.

6. The circuit configuration according to claim 2, wherein the time lag is 60 seconds.

7. The circuit configuration according to claim 2, wherein the device for driving the fluid is a refrigerant compressor.

8. A refrigeration appliance, comprising:

a refrigerant compressor;

an insulated housing having two storage compartments operating at different temperatures, each of said two storage compartments having an evaporator connected to said refrigerant compressor;

a circuit configuration for operating an electrically triggerable magnet valve having a valve-control element adjustable into at least two working positions for selecting one fluid-flow path at a time to be acted upon by a fluid and corresponding to a respective working position, said magnet valve connected to each of said evaporators;

said circuit configuration having a device for adjusting the valve-control element into a different working position in connection with an imposition of fluid, predominantly present in liquid components, on at least a portion of a fluid-flow path formed by the magnet valve.

* * * * *